United States Patent [19]

Wilkinson

[11] 4,375,308

[45] Mar. 1, 1983

[54] PLUG-IN COUNTER MODULE

[75] Inventor: Richard P. Wilkinson, Simsbury, Conn.

[73] Assignee: Veeder Industries Inc., Hartford, Conn.

[21] Appl. No.: 263,849

[22] Filed: May 15, 1981

[51] Int. Cl.[3] ..... H01R 13/66

[52] U.S. Cl. ..... 339/17 C; 339/32 R; 339/193 P

[58] Field of Search ..... 339/31–33, 339/196, 17 C, 193 P; 235/92 CT, 92 SB, 92 DE; 361/405, 406; 200/51.03, 51.05

[56] References Cited

U.S. PATENT DOCUMENTS 3,719,805 3/1973 Tano ..... 235/92 CT X
3,878,371 4/1975 Burke ..... 235/92 PD

FOREIGN PATENT DOCUMENTS 562591 3/1957 Italy ..... 339/31 R

*Primary Examiner*—Joseph H. McGlynn
*Attorney, Agent, or Firm*—Prutzman, Kalb, Chilton & Alix

[57] ABSTRACT

A plug-in counter module having a generally universal terminal adapter for selectively locating male electrical terminals of the module for use of the module in most conventional receptacles.

5 Claims, 6 Drawing Figures

PLUG-IN COUNTER MODULE

DESCRIPTION

TECHNICAL FIELD & BACKGROUND

The present invention generally relates to plug-in counter systems of the type disclosed in British Pat. No. 855,114, published Nov. 30, 1960 and entitled "Improvements In Or Relating To Counting Devices" and having a plug-in counter module adapted to be axially inserted into a plug-in counter receptacle operating system for remote electrical operation of the plug-in counter module and more particularly relates to a new and improved plug-in counter module useful with most conventional plug-in counter receptacle operating systems.

Several companies are engaged in the manufacture and sale of plug-in counter systems having a plug-in counter receptacle with female electrical terminals and a plug-in counter module with corresponding male electrical terminals and adapted to be inserted into the receptacle for electrically connecting the plug-in counter module for remote electrical operation by a predetermined electrical pulse or signal. Although the physical size of the plug-in counter modules and plug-in counter receptacles has been generally standardized by the principal companies engaged in their manufacture, the position of the female terminals is not standardized and so that each plug-in counter module is useful with only some of the available receptacle operating systems. Therefore, commercially available plug-in counter modules are not completely interchangeable and any replacement plug-in counter module must have a specified design which is compatible with the plug-in counter receptacle operating system with which it is to be used.

DISCLOSURE OF INVENTION

It is a principal aim of the present invention to provide a new and improved plug-in counter module useful with most plug-in counter receptacle operating systems.

Another aim of the present invention is to provide a generally universal terminal adapter for a plug-in counter module for selectively locating the electrical terminals of the plug-in counter module for use with most conventional plug-in counter receptacle operating systems.

It is a further aim of the present invention to provide a new and improved plug-in counter module which can be used as a direct replacement for existing plug-in counter modules irrespective of the position of their electrical terminals.

It is a further aim of the present invention to provide a new and improved plug-in counter module of the type described which has a long, useful, service-free life and which can be substituted for existing plug-in counter modules in the field.

It is another aim of the present invention to provide a new and improved plug-in counter module having a resettable counter which may be remotely reset via the plug-in counter receptacle operating system.

Other objects will be in part obvious and in part pointed out more in detail hereinafter.

A better understanding of the invention will be obtained from the following detailed description and the accompanying drawing of an illustrative application of the invention.

BEST MODE FOR CARRYING OUT THE INVENTION

Figure 1:
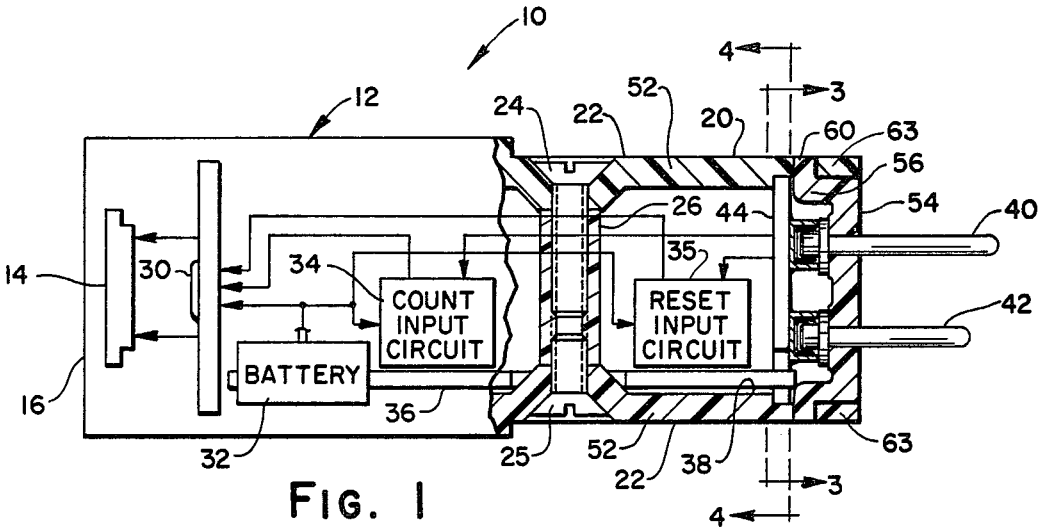
FIG. 1 is a longitudinal view, partly broken away, partly in section and partly diagrammatic, of a plug-in counter module incorporating a preferred embodiment of the present invention.
Figure 2:
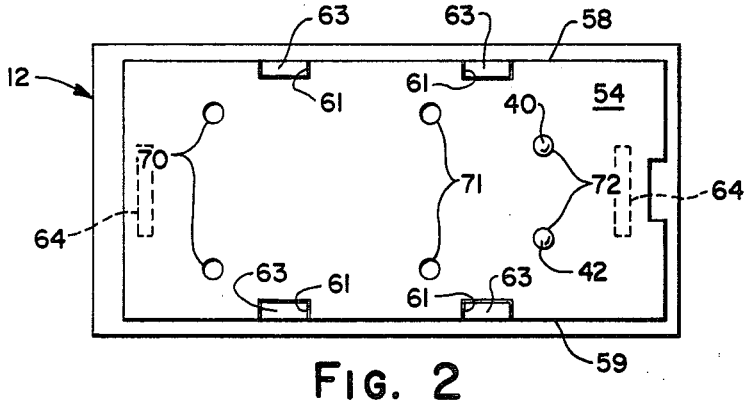
FIG. 2 is a rear end view of the plug-in counter module.

Referring now to the drawing in detail wherein like numerals represent like parts throughout, a plug-in counter or totalizer module 10 incorporating an embodiment of the present invention is shown having an elongated outer casing 12 with a box-like shape and a rectangular cross section. A six digit liquid crystal display 14 is provided at the front end 16 of the counter module for registering or displaying the accumulated count or total of a resettable electronic counter of the module. A push button 18 is also provided at the front end 16 of the counter module 10 for manually resetting the electronic counter, for example to "000000".A rear end section 20 of the outer casing 12 has a slightly reduced transverse rectangular cross section of generally standardized height and width for inserting the rear end 20 of the counter module into any one of a plurality of different conventional plug-in counter receptacles (not shown) having rectangular openings or sockets of conforming standardized dimensions.

The plug-in counter module casing 12 is formed by identical upper and lower molded plastic casing sections or halves 22 which are mounted in edge-to-edge abutment to provide the generally box-like casing structure described. The two casing halves 22 are secured together by a pair of opposed aligned threaded screw fasteners 24, 25 received in an internally threaded spacer sleeve 26 provided intermediate the upper and lower casing halves 22.

The resettable electronic counter is provided by a suitable LSI chip 30 which is connected to the liquid crystal display 14 for registering the accumulated count or total of the electronic counter. A battery 32 is provided for supplying power to the LSI chip 30 and liquid crystal display 14 and to a count input circuit 34 and a reset input circuit 35 of a counter operating circuit. The battery 32 is preferably a 3 V lithium type battery capable of supplying adequate power over a useful life of up to ten years or more. The counter operating circuit is preferably constructed like that shown and described in pending U.S. patent application Ser. No. 062,346 of Richard K. Lucas et al, filed July 31, 1979 and entitled "Battery Powered Electronic Counter" (and assigned to the same assignee as the present application) and therefore is not shown and described in detail herein.

Figure 3:
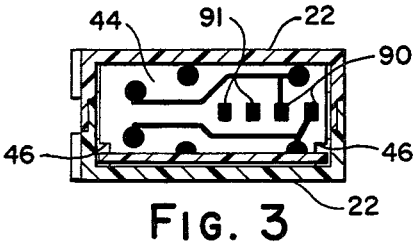
FIGS. 3 and 4 are reduced transverse section views of the plug-in counter module, taken generally along the lines 3—3 and 4—4 respectively of FIG. 1, showing front and rear views respectively of a printed circuit (PC) terminal adapter board of the plug-in counter module.
Figure 4:
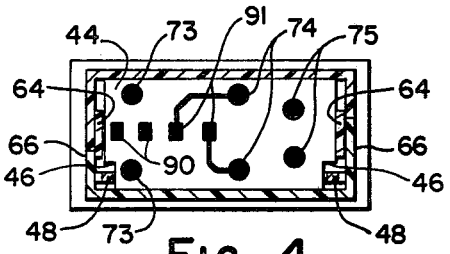
Figure 5:
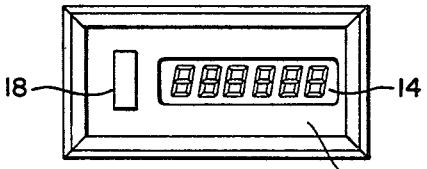
FIG. 5 is a reduced front end view of the plug-in counter module.
Figure 6:
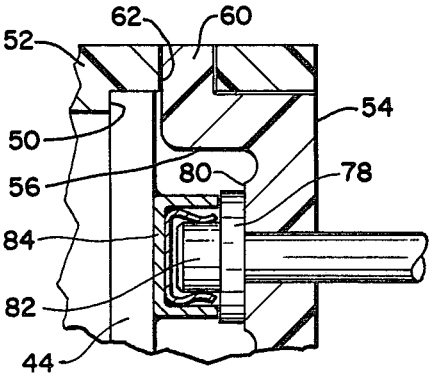
FIG. 6 is an enlarged, partial longitudinal section view, partly broken away and partly in section, of the plug-in counter module.

The counter operating circuit is provided in part on a main circuit board 36 extending longitudinally adjacent and parallel to the bottom 38 of the casing 12 and in part by male input terminals 40 and/or 42 and a terminal printed circuit (PC) board 44 connected between the male input terminals and the main circuit board 36. The terminal PC board 44 has a rectangular shape as seen in FIGS. 3 and 4, except for a pair of locating notches 46 provided at the bottom corners of the board 44 for receiving two rearwardly projecting tangs 48 of the main circuit board 36. The terminal PC board 44 is mounted transversely within the casing 12 at the rear end of the counter module 10 and in engagement with a pair of transversely extending and rearwardly facing internal shoulders 50 on the top and bottom walls 52 of the casing 12.

A molded plastic back plate 54 is mounted parallel to and rearwardly of the terminal PC board 44 and with its front face engaging the rear ends of the two casing halves 22. The back plate 54 has a pair of laterally spaced, integral, forwardly projecting hooks 56 at both its top and bottom edges 58, 59 for receipt of their outwardly projecting rectangular ends 60 within corresponding openings 62 in the top and bottom walls 52 of the two casing halves 22. Also, peripheral rectangular notches or slots 61 are provided in the back plate 54 outwardly of the hooks 56 to receive rearwardly projecting integral locating tabs 63 of the top and bottom walls 52 of the two casing halves 22. The hooks 56 also engage the terminal PC board to hold it against the locating shoulders 50 of the casing 12, and the back plate 54 has a pair of forwardly projecting integral rectangular posts 64 engageable with the opposed parallel side walls 66 of the casing and with the edges of the terminal PC board 44 for maintaining the back plate 54 and terminal PC board in predetermined relationship. The back plate 54 can be installed on or removed from the casing 12 merely by partly unscrewing the upper, relatively long casing mounting screw 24, withdrawing the upper casing half 22 and then removing and/or installing the back plate 54.

The back plate 54 and terminal PC board 44 are designed for mounting either of two pairs of male terminal pins 40, 42 at three different transverse positions at the rear end of the plug-in counter module. Those three terminal pin positions are predetermined for alignment of the male terminal pins 40 or 42 for receipt within corresponding female terminals of most conventional plug-in counter receptacles (not shown but which generally have the same standardized receptacle size and configuration except for the transverse position of their terminals). The plug-in counter module 10 can thereby be made physically compatible with most conventional plug-in counter receptacle operating systems.

The physical adaptability of the module 10 is made possible by the provision of three pairs 70–72 of pin locating openings in the back plate 54 and three corresponding pairs 73–75 of PC terminal pads on the terminal PC board 44 in alignment with the locating openings. Each male terminal pin 40, 42 is adapted to be inserted rearwardly through each locating opening in the back plate 54 and so that an intermediate integral collar 78 of the terminal pin engages a forward face of a corresponding forwardly projecting boss 80 of the back plate 54. A forward short section 82 of the terminal pin is received within a cup-shaped terminal or socket 84 soldered to the corresponding PC pad of the terminal PC board 44 to electrically connect the male terminal pin to the terminal PC board 44. The terminal sockets 84 are shown mounted on the rear face of the terminal PC board 44. Alternatively, the sockets 84 could be secured within openings in the terminal PC board 44.

Accordingly, a pair of male terminal pins 40 and 42 can be selectively installed within any selected pair 70–72 of back plate openings, merely by loosening the upper long casing screw 24, separating the casing halves 22 and removing the back plate 54, inserting the ends 82 of the pair of terminal pins in the selected pair of terminal PC board sockets 84 and then reinstalling the back plate 54 by first inserting the rearwardly extending ends of the terminal pins through the corresponding pair 70–72 of openings in the back plate 54 and then closing the casing with the long casing screw 24 while holding the back plate 54 in proper position against the terminal PC board 44.

Since some plug-in counter receptacles employ female terminals designed for different length male terminal pins, two pairs of relatively short and relatively long male terminal pins 40, 42 are preferably provided with each plug-in counter module 10 for use of the proper length terminal pins 40, 42 at the selected installation. The plug-in counter module 10 is thereby made fully adaptable in terms of the position and length of the male terminal pins to most conventional plug-in counter receptacles. Also, other terminal positions can be provided on the back plate 54 and terminal PC board 44 as found desirable to make the plug-in counter module 10 compatible with receptacles having other female terminal positions.

The terminal PC board 44 has two separate pairs 90, 91 of PC contact pads for electrically connecting the PC board 44 to the counter operating circuit 34 on the main circuit board 36. The PC counter pads and the PC terminal pads are provided on both sides of the terminal PC board 44 with the two sides of each pad electrically connected by openings in the center of the pad extending through the PC board. One pair 90 of the PC contact pads is connected to the outer two pairs 73, 75 of the three pairs 73–75 of PC terminal pads via a printed circuit of the PC board 44 on the front face of the terminal PC board 44. The remaining intermediate pair 74 of PC terminal pads is connected to the other pair 91 of PC contact pads via a printed circuit on the rear face of the terminal PC board 44. The pair 90 of PC contact pads is provided for transmitting counter stepping signals for indexing the electronic counter and therefore is electrically connected by suitable wiring to the count input circuit 34. The other pair 91 of contact pads is provided for transmitting counter reset signals for resetting the counter and therefore is connected by suitable wiring to the reset input circuit.

Thus, in plug-in counter receptacle systems having female terminals corresponding to either of the outer two pairs of terminal positions of the plug-in counter module 10, a stepping signal is transmitted via a pair of installed male terminal pins 40 or 42 and the terminal PC board 44 to the main circuit board 36 for indexing the electronic counter. Also, in plug-in counter receptacle systems having female terminals corresponding to the intermediate pair of terminal positions of the plug-in counter module 10, those receptacle terminals and module terminal positions can be employed for transmitting a reset signal via installed male terminal pins and the terminal PC board 44 to the reset input circuit 35 for resetting the electronic counter. Accordingly, the plug-in counter module is not only physically adaptable to the different conventionally available plug-in counter systems, it is also adaptable to receive both indexing and reset signals from such receptacle systems.

As will be apparent to persons skilled in the art, various modifications, adaptations and variations of the foregoing specific disclosure can be made without departing from the teachings of the present invention.

I claim:

1. In a plug-in counter module having a counter and a counter operating circuit with male electrical terminals at a rear end of the module adapted to be axially inserted into corresponding female electrical terminals of a plug-in counter receptacle, upon axial insertion of said rear end of the plug-in counter module into the receptacle, for electrical operation of the counter, the improvement wherein the counter operating circuit comprises a plurality of individual, selectively mountable male terminals, an electrical terminal board, extending transversely of the axis of insertion of the module, with a plurality of transversely spaced electrical terminals providing a plurality of different transversely spaced male terminal positions respectively at the rear end of the counter module in axial alignment and electrical connection with respective board terminals, a transversely extending male terminal support means mounted in predetermined spaced relationship with said terminal board rearwardly thereof, the male terminal support means having means for supporting a male terminal at each of said transversely spaced male terminal positions and being separable from the terminal board, for selectively mounting male terminals at a plurality of different male terminal positions for insertion into respective female terminals at different transverse positions thereof in different plug-in counter receptacles, and mounting means for mounting the transversely extending male terminal support means in said predetermined relationship with said terminal board and for selectively separating the male terminal support means from the terminal board to provide for selectively mounting the male terminals.

2. A plug-in counter module according to claim 1 wherein the male terminal support means comprises a transverse retention plate rearwardly of the terminal board in spaced generally parallel relationship therewith and having an opening aligned with each said board terminal for mounting a male terminal therein, and wherein each said male terminal has retention means for receipt between the retention plate and terminal board for retaining the male terminal against rearward removal from the retention plate.

3. A plug-in counter module according to claim 1 or 2 wherein each board terminal comprises an electrical socket secured to the terminal board for receiving the respective male terminal for electrically connecting the male terminal to the terminal board.

4. A plug-in counter module according to claim 1 or 2 wherein the terminal board is a PC board.

5. A plug-in counter module according to claim 4 wherein the PC board has a plurality of PC contact pads for each set of board terminals, wherein the counter operating circuit comprises a separate electrical connection to each PC board contact for separate operation of the counter and wherein the PC board has PC circuit means for electrically connecting the PC contact pads to different board terminals.

* * * * *